US010654628B2

(12) United States Patent
Van Den Hoonaard et al.

(10) Patent No.: US 10,654,628 B2
(45) Date of Patent: May 19, 2020

(54) CAP FOR A POUCH

(71) Applicant: Scholle IPN Corporation, Northlake, IL (US)

(72) Inventors: Paul Van Den Hoonaard, Peachtree City, GA (US); Kyle Erickson, Northlake, IL (US)

(73) Assignee: Scholle IPN IP BV, Tilburg (NL)

( * ) Notice: Subject to any disclaimer, the term of this patent is extended or adjusted under 35 U.S.C. 154(b) by 0 days.

(21) Appl. No.: 15/800,759

(22) Filed: Nov. 1, 2017

(65) Prior Publication Data

US 2019/0127129 A1 May 2, 2019

(51) Int. Cl.

| | |
|---|---|
| ***B65D 43/04*** | (2006.01) |
| ***B65D 51/24*** | (2006.01) |
| ***B65D 41/04*** | (2006.01) |
| ***B65D 47/12*** | (2006.01) |
| ***B65D 85/72*** | (2006.01) |
| ***B65D 33/06*** | (2006.01) |
| ***B65D 81/36*** | (2006.01) |
| ***B65D 75/58*** | (2006.01) |
| ***A63H 33/08*** | (2006.01) |

(52) U.S. Cl.

CPC ..... *B65D 47/122* (2013.01); *A63H 33/08* (2013.01); *B65D 33/06* (2013.01); *B65D 41/0485* (2013.01); *B65D 51/24* (2013.01); *B65D 75/5883* (2013.01); *B65D 81/361* (2013.01); *B65D 85/72* (2013.01)

(58) Field of Classification Search

CPC ..... B65D 47/122; B65D 33/06; B65D 85/72; B65D 41/0485; B65D 51/24; B65D 75/5883; B65D 81/361; A63H 33/08

USPC ..... 220/212, 212.5, 756; 215/228; 446/124; D9/436, 443

See application file for complete search history.

(56) References Cited

U.S. PATENT DOCUMENTS

| | | | | |
|---|---|---|---|---|
| 5,361,919 A * | 11/1994 | Hull | B65D 81/361 215/228 |
| 6,702,642 B1 * | 3/2004 | Parein | A63H 33/08 446/105 |
| 6,739,935 B2 * | 5/2004 | Van Teunenbroek | A63H 37/00 273/451 |
| 7,371,146 B2 * | 5/2008 | Scarborough | A63H 33/062 446/108 |

(Continued)

FOREIGN PATENT DOCUMENTS

| | | |
|---|---|---|
| CN | 104891007 A | 9/2015 |
| WO | 2013033962 A1 | 3/2013 |

*Primary Examiner* — J. Gregory Pickett
*Assistant Examiner* — Niki M Eloshway
(74) *Attorney, Agent, or Firm* — The Watson IP Group, PLC; Jovan N. Jovanovic

(57) ABSTRACT

A cap for a pouch including a spout engaging body, a handle member and a multimode handle coupling assembly. The spout engaging body includes a depending skirt defining a central bore configured to engage a spout. The handle member extends from the spout engaging body. The multimode handle coupling assembly includes at least one handle tab formed into the handle member and at least one mode three slot. The at least one mode three slot includes a multi direction slot defined in the handle member having a central opening and a plurality of radial slot portion pairs, to, in turn, sized to receive a handle tab of another cap in a plurality of orientations.

19 Claims, 10 Drawing Sheets

(56) References Cited

U.S. PATENT DOCUMENTS

| | | | | |
|---|---|---|---|---|
| 8,695,820 | B2 * | 4/2014 | Rabie | B65D 21/0204 206/508 |
| D736,625 | S * | 8/2015 | Laureano | D9/454 |
| 9,539,519 | B2 * | 1/2017 | Vollers | B65D 81/361 |
| 9,975,659 | B2 * | 5/2018 | McConnell | B65D 21/0217 |
| 2012/0211460 | A1 | 8/2012 | Tamarindo | |
| 2014/0263317 | A1 * | 9/2014 | Linder | B65D 41/0485 220/212.5 |
| 2015/0165337 | A1 * | 6/2015 | Lopez | A63H 33/067 446/124 |
| 2017/0158382 | A1 | 6/2017 | Mazurkiewicz | |

* cited by examiner

CAP FOR A POUCH

CROSS-REFERENCE TO RELATED APPLICATION

N/A

BACKGROUND OF THE DISCLOSURE

1. Field of the Disclosure

The disclosure relates in general to a cap for a pouch, and more particularly, to a cap that provides utility both as a closure member, and a toy that can be coupled to other cap members to make structures. It will be understood that while the same is discussed in the context of a pouch, pouch shall include, herein, containers of all types, both rigid and flexible.

2. Background Art

Generally, once the contents of a pouch containing foodstuffs, for example, have been consumed, the pouch, along with the cap is discarded. Typically, such pouches and caps end up in a landfill. It would be helpful if such caps had additional utility.

It has been known from the prior art that one manner in which to enhance the utility of such caps is to provide for the coupling of caps together to form a toy, for example. One such bottle cap and construction toy is shown in U.S. Pat. No. 5,361,919 issued to Hull et al. Another such construction is shown in GB Specification 2410493. Still another construction is shown in U.S. Pat. No. 9,016,473 issued to Tamarindo.

While these designs have advanced the art, these solutions nevertheless have deficiencies. For example, some of the constructions are limited to coupling in few manners, thereby allowing stacking or planar coupling. Other configurations are even more limited as to how multiple caps can be assembled. Further still, many of the constructions require a large quantity of caps prior to forming a meaningfully sized structure in that the close proximity and small nature of the caps is limiting.

Thus, it is an object of the present invention to provide a cap for a pouch (or other container) which can provide additional utility as a toy.

SUMMARY OF THE DISCLOSURE

The disclosure is directed, in one aspect, to a cap for a pouch (wherein it will be understood that pouch may refer and does refer to any type of container, rigid or flexible) that includes a spout engaging body, a handle member and a multimode handle coupling assembly. The spout engaging body includes a depending skirt defining a central bore configured to engage a spout. The handle member extends from the spout engaging body. The multimode handle coupling assembly includes at least one handle tab formed into the handle member and at least one mode three slot. The at least one mode three slot includes a multi direction slot defined in the handle member having a central opening and a plurality of radial slot portion pairs, to, in turn, sized to receive a handle tab of another cap in a plurality of orientations.

In some configurations, the multi direction slot includes at least four radial slot portion pairs, intersecting at the central opening, and radially spaced about the central opening.

In some configurations, the at least one mode three slot includes at least two mode three slots defined in the handle member.

In some configurations, the depending skirt defines an axis of rotation, with the handle member defining a planar configuration that bisects the depending skirt and extends through the axis of rotation.

In some configurations, the axis of rotation bisects the handle member. One of the at least two mode three slots is positioned on a first side of the axis of rotation and the other of the at least two mode three slots is positioned on a second side of the axis of rotation.

In some configurations, the at least one handle tab comprises a first handle tab and a second handle tab. The first handle tab extends from the handle member on the first side of the axis of rotation such that the mode three slot on the first side of the axis is positioned between the first handle tab and the axis of rotation. The second handle tab extends from the handle member on the second side of the axis of rotation such that the mode three slot on the second side of the axis is positioned between the second handle tab and the axis of rotation.

In some configurations, the first handle tab corresponds spatially to one radial slot portion pair such that when a handle tab of a second cap is inserted therethrough, a plane defined by a lower end of the depending skirt of the cap, and a plane defined by a lower end of the depending skirt of the second cap are coplanar.

In some configurations, the cap further comprises at least one mode one slot and at least one mode two slot. Each of the at least one mode slot and the at least one mode two slot structurally configured to receive a handle tab of a second cap in two orientations.

In some configurations, the at least one mode slot is oriented perpendicular to the at least one mode two slot.

In some configurations, the at least one mode one slot comprises a first mode one slot and a second mode one slot. The first mode one slot is positioned between the first mode three slot and the first handle tab and the second first mode one slot is positioned between the second mode three slot and the second handle tab.

In some configurations, the at least one mode two slot is positioned between the first mode three slot and the second mode three slot, so as to straddle the axis or rotation.

In some configurations, the cap further comprises a first stacking coupling assembly including a spout engagement portion on the spout engagement body and a handle engagement portion on the handle member. The handle engagement portion and the spout engagement portion include mating structures such that the spout engagement portion of the cap is structurally configured to releasably couple to a handle engagement portion of a second cap in a stacked configuration.

In some configurations, the handle engagement portion further comprises a first handle mating structure including a slot and a second handle mating structure including a slot. The slots define a mating configuration to the spout engagement portion.

In some configurations, the first and second handle mating structures are positioned at an upper end of a central region of the handle member.

In some configurations, the handle member further includes a first wing region positioned to a first side of the central region and a second wing region positioned on a second side of the central region. The at least one handle tab comprises a first handle tab extending from the first wing region and a second handle tab extending from the second wing region. The at least one mode three slot comprises a first mode three slot defined in the first wing region inboard of the first handle tab, and a second mode three slot defined in the second wing region inboard of the second handle tab.

In another aspect of the disclosure, the disclosure is directed to a cap for a pouch that includes a spout engaging body, a handle member, a multimode handle coupling assembly and a first stacking coupling assembly. The spout engaging body includes a depending skirt defining a central bore configured to engage a spout. The handle member extends from the spout engaging body. The multimode handle coupling assembly includes at least one handle tab formed into the handle member and at least one mode three slot. The at least one mode three slot includes a multi direction slot defined in the handle member having a central opening and a plurality of radial slot portion pairs, to, in turn, sized to receive a handle tab of another cap in a plurality of orientations. The first stacking coupling assembly is structurally configured to couple one of the handle member of the cap to a spout engaging body of a second cap or the spout engaging body of the cap to a handle member of a second cap.

In some configurations, the multimode handle coupling assembly further comprises at least one mode one slot defined in the handle member and at least one second mode slot defined in the handle member.

In another aspect of the disclosure, the disclosure is directed to a method of coupling an assembly of caps comprising a first cap and a second cap. The method comprises the steps of: providing a first cap and a second cap, each cap having the configurations such as those configurations identified above; and attaching the second cap to the first cap through one of the multimode handle coupling assembly and the first stacking coupling assembly.

In some configurations, the method further includes the steps of: providing a subsequent cap; coupling the subsequent cap to a previously assembled cap; and repeating the steps of providing and coupling. It will be understood that these steps can be repeated to build structures with unlimited numbers of caps. The assembly of caps itself forms another aspect of the disclosure, and such assemblies can be provided in kits or alone as a user purchases a pouch, and opens the pouch, and then has utilized the cap for its initial intended purpose, at which time, the cap can be used for other purposes. It will be understood that caps still coupled to pouches can be attached to each other through the multimode handle coupling assembly. It will further be understood that the cap that is still coupled to a pouch can be coupled to other caps utilizing the first stacking coupling assembly, and in particular the handle engagement portion of such a cap that is coupled to a pouch.

BRIEF DESCRIPTION OF THE DRAWINGS

The disclosure will now be described with reference to the drawings wherein.

DETAILED DESCRIPTION OF THE DISCLOSURE

Figure 1:
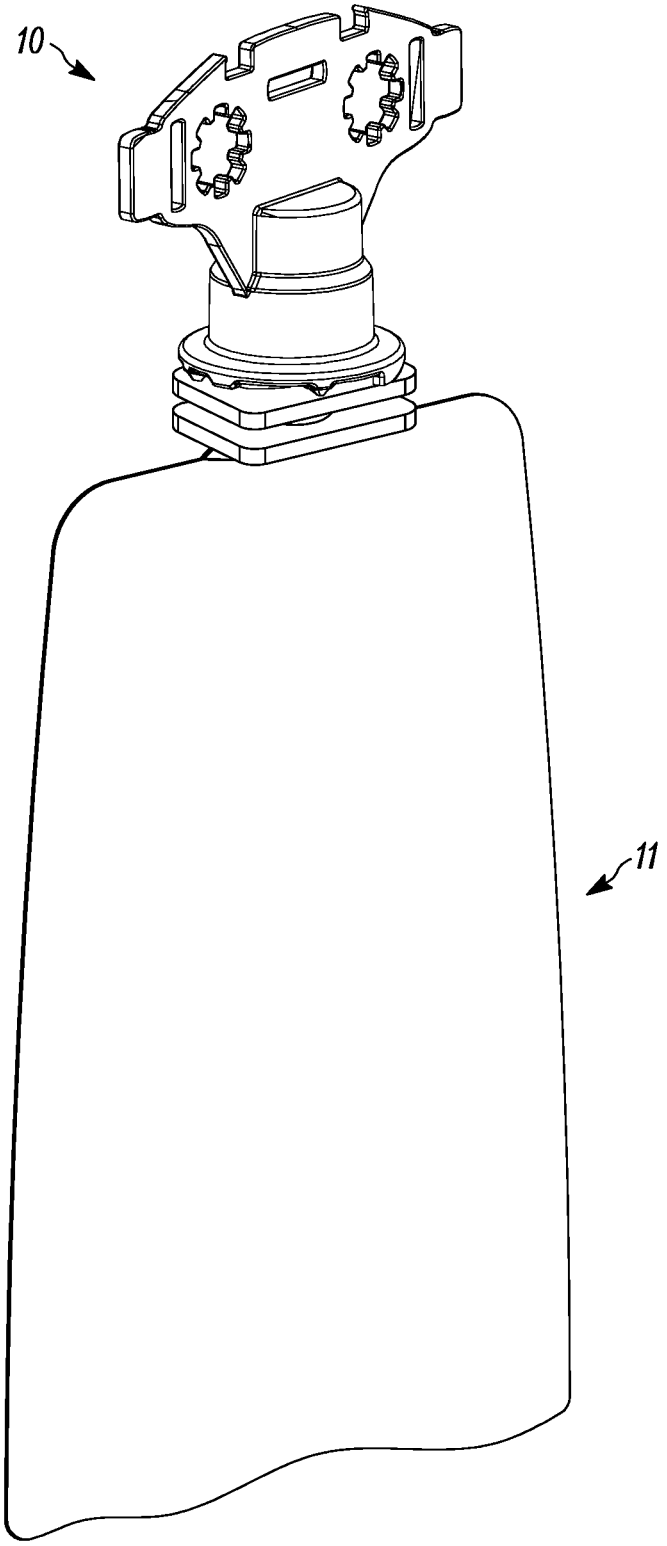
FIG. 1 of the drawings is a perspective view of a pouch having a spout with a cap positioned thereon.
Figure 2:
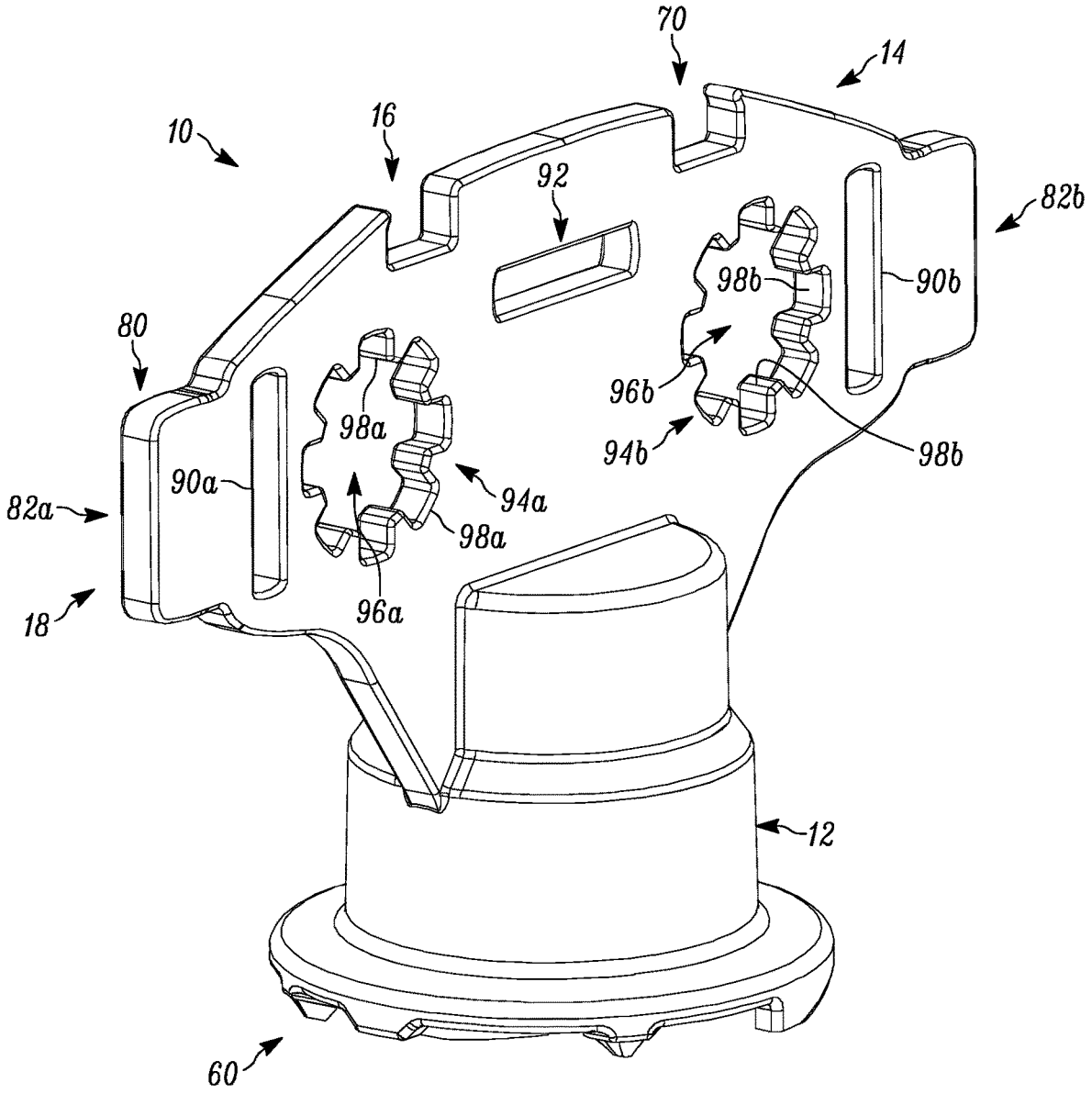
FIG. 2 of the drawings is a perspective view of a cap for a pouch.
Figure 3:
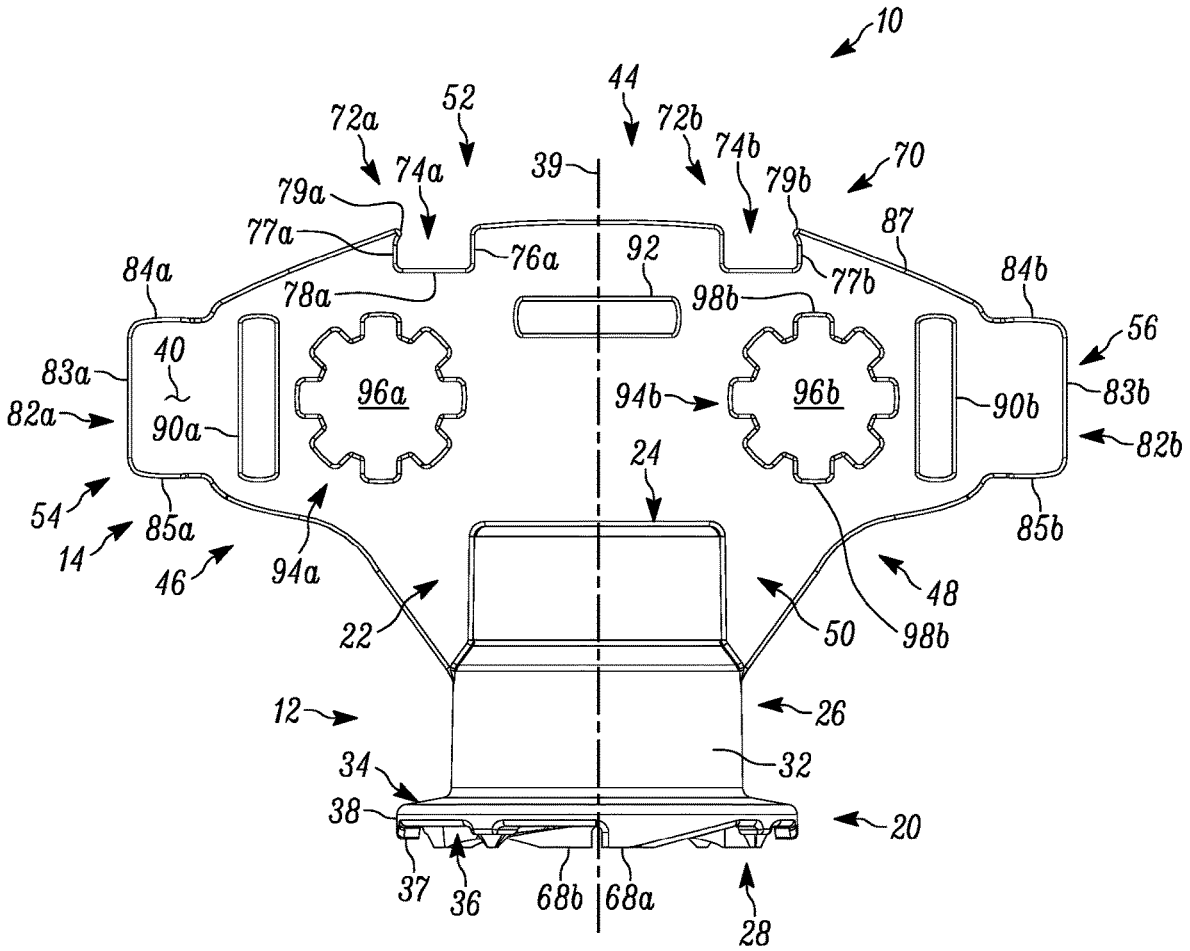
FIG. 3 of the drawings is a side elevational view of the cap for a pouch.
Figure 4:
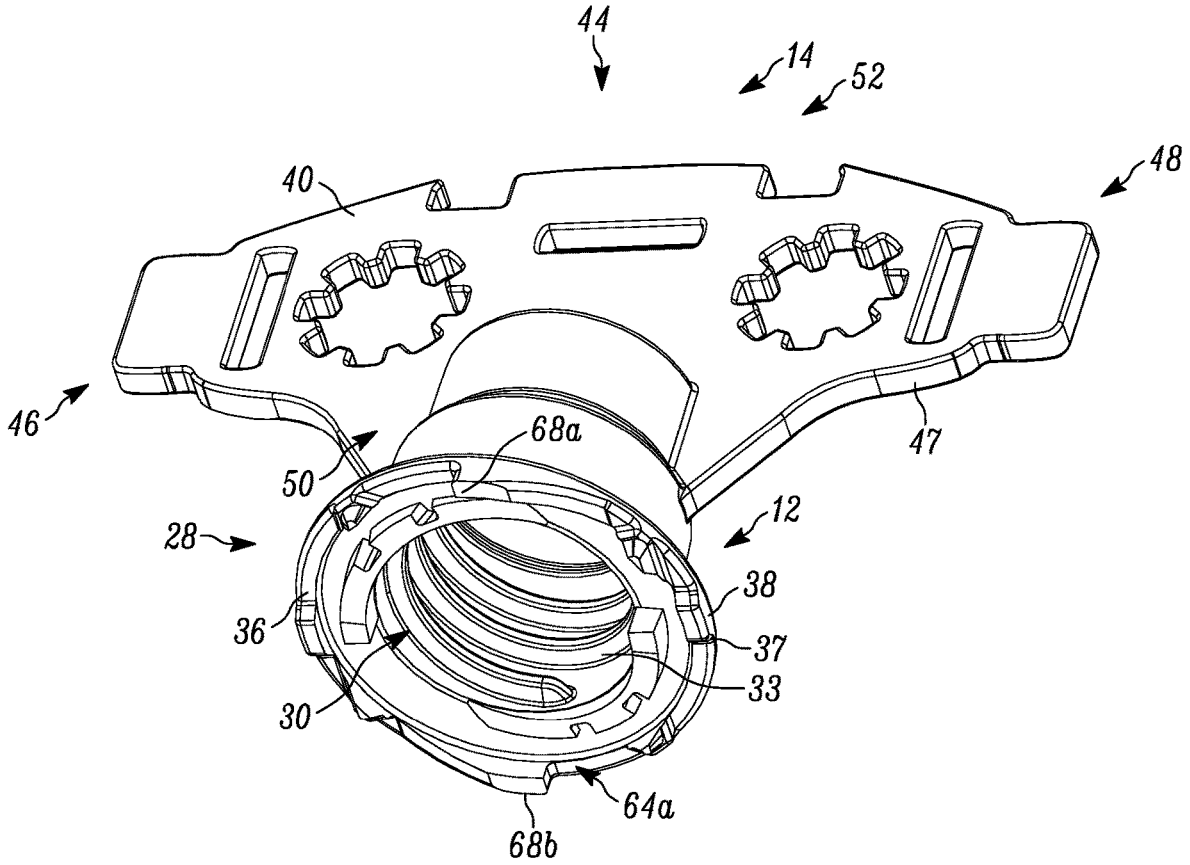
FIG. 4 of the drawings is a bottom perspective view of the cap for a pouch.
Figure 5:
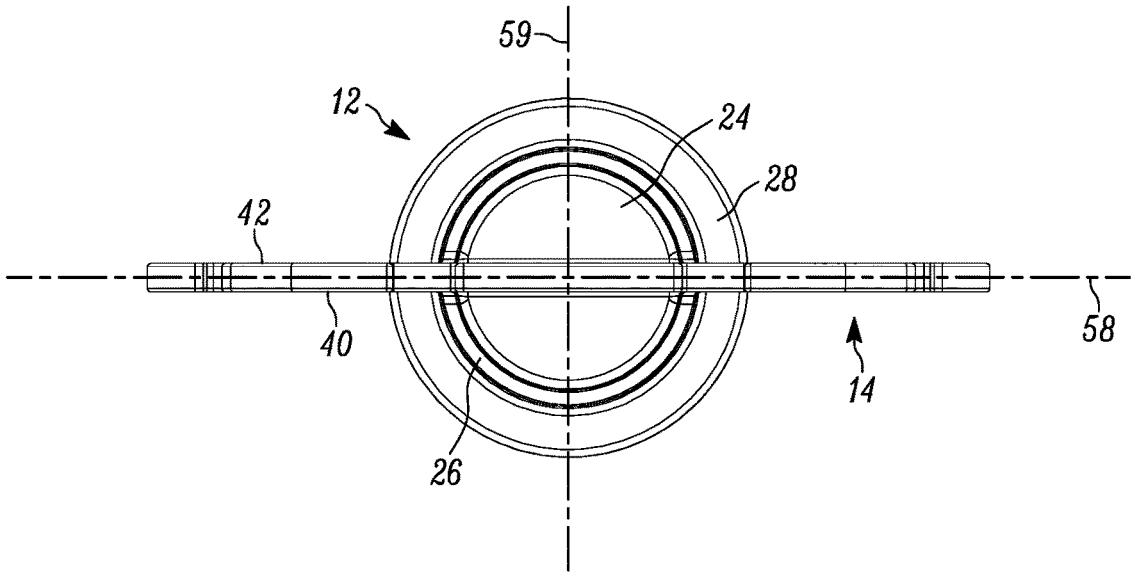
FIG. 5 of the drawings is a top plan view of the cap for a pouch.
Figure 6:
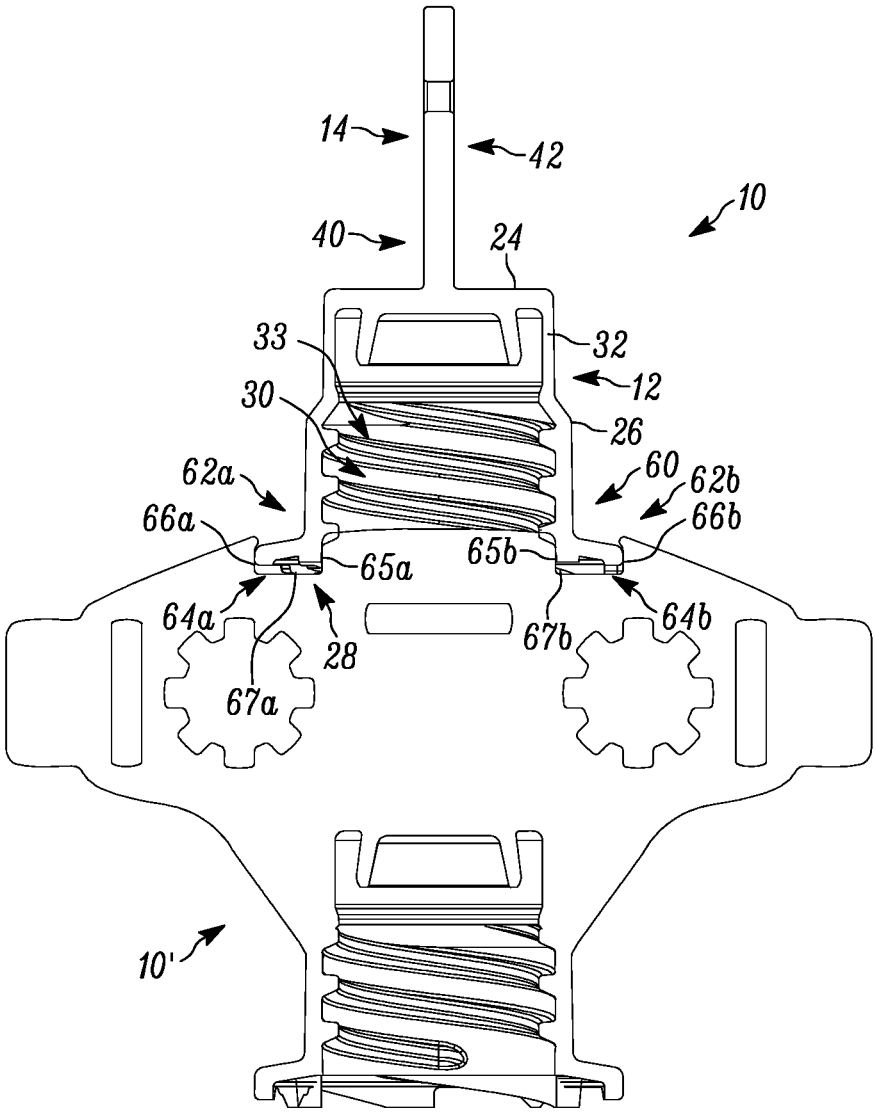
FIG. 6 of the drawings is a cross-sectional view of two caps coupled together, showing, in particular, the first stacking coupling assembly of two adjacent caps in a coupled configuration.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the cap for a pouch is disclosed at 10. The cap 10 is configured for use in association with, for example, a pouch such as pouch 11. The pouch 11 is of the type that is often utilized for foodstuffs, and, at times, for children's foodstuffs, including, but not limited to, for example, sauces and purees (including what is commonly referred to as baby food). Such a pouch is typically on the order of retaining three to four ounces of foodstuffs (approximately 90 g to 115 g). Of course, the disclosure is not limited to any particular pouch, or to any particular material retained in such a pouch. The foregoing is merely exemplary and are not to be deemed limiting. For example, the cap may be utilized with containers other than pouches, and may be utilized with materials other than foodstuffs. Any reference to a pouch will be understood to apply to other types of containers, both flexible and rigid.

The cap 10 is shown in greater detail in FIGS. 2 through 6 as comprising spout engaging body 12 and handle member 14. The cap further defines a first stacking coupling assembly 16 and a multimode handle coupling assembly 18, which are defined by structures on the body 12 and/or the handle member 14 and can be utilized to couple various caps together in releasable engagement. As a result, the caps can be utilized as toys to engage a child, for example, and the caps can be utilized to build structures. Some of such structures are shown in FIGS. 7 through 11. The configuration of the structures is bound by the coupling assemblies along with the imagination of the child or other user.

The body and the handle member are integrally molded, preferably from a polymer. It will be understood that other configurations having additional components are contemplated. One such multi-component cap is shown and described in U.S. Pat. No. 9,751,677 B2 issued to Scholle IPN Corporation of Northlake, Ill., the entire disclosure of which is hereby incorporated by reference in its entirety. It is contemplated that, for example, the structures of the plug may be incorporated into the present cap 10. Other configurations are likewise contemplated for the cap member. It is further contemplated that the body and the handle member may comprise separate components that are coupled together in fixed engagement, through, for example, adhesion, press fitting, heat sealing, RF welding, among others.

With reference to FIGS. 2 through 6, the spout engaging body 12 includes lower end 20 and upper end 22. The body further includes top surface 24 and depending skirt 26 which terminates at a lower annular flange 28. The top surface 24, in the configuration shown is generally parallel to the lower annular flange 28, and is generally circular in configuration, defining a central axis 39, which substantially corresponds to the axis of rotation of the spout engaging body relative to a spout of the pouch. The depending skirt 26 extends, or depends, downwardly therefrom in a generally cylindrical configuration, defining an outer surface 32 and a central bore 30. The central bore, in the configuration shown, includes threads 33 which correspond to mating threads on the spout of the pouch. The central bore may further include sealing structures proximate the top surface for sealing engagement with the spout. In the configuration shown, the depending skirt includes a pair of generally cylindrical configurations with a frustoconical configuration spanning therebetween. The upper one of the cylindrical configurations having a diameter that is smaller than that of the lower one of the cylindrical configurations. Furthermore, in the configuration shown, the threads 33 may be confined to the lower one of the cylindrical configurations. In other caps, the depending skirt may have a different outer surface configuration, such as parabolic, stepped, or otherwise. The cross-sectional configuration of the depending skirt may further be polygonal elliptical or may have another shape or configuration.

The lower annular flange 28 extends outwardly at the lower end 20 from the depending skirt, proximate the opening. The lower flange includes upper surfaced 34, lower surface 36 and defines outer edge 38. The outer lip, in the configuration shown, may include a downwardly depending outer lip 37. In the configuration shown, the lower flange defines a plane that is substantially perpendicular, or slightly oblique to the axis of rotation 39. The lower flange as well as the lower end of the depending skirt may include structures which interface with the spout to facilitate locking therewith, tamper evident structures, or other interfacing or cooperative structures. Additionally, frangible portions may be associated with the spout engaging body, which frangible portions may provide evidence of tampering.

The handle member 14 extends from the spout engaging body 12 in a direction away from the upper end 20 thereof. In the configuration shown, the handle member defines a generally planar member that includes a first side 40 and a second side 42. The planar member defines a first bisecting plane 58 that is generally parallel to the axis of rotation 39, and through which the axis of rotation 39. The first bisecting plane extends through a diameter of the top surface 24. A second plane is defined perpendicular thereto, namely plane 59 that likewise extends through the axis of rotation 39.

The handle member 14 has a central region 44, with a first wing region 46 on one side thereof and a second wing region 48 on a second side thereof. The central region 44 includes a root 50 proximate the top surface 24 and an upper end 52. The first wing region extends to one side of the central region, and terminates at an outward end 54. The second wing region extends to the opposite side of the central region from the first wing region, and terminates at the outward end 56. In the configuration shown, the handle member is symmetrical about the bisecting plane 59 (as is the spout engaging body 12). In the configuration shown, the first wing region and the second wing region span outwardly well beyond the spout engaging body. That is, in the configuration shown, the first and second wing regions extend more than twice as far from the axis 39 as the outer edge 38 of the lower flange 28. Additionally, the handle member extends away from the top surface 24 of the spout engaging body a distance that is similar to the height of the spout engaging body itself. Various configurations are contemplated, bearing in mind special constraints related to filling equipment, plastics usage, as well as the dimensions of the pouch, and the weight of the contents thereof, among others.

It is additionally contemplated that the handle member may be other than substantially planar, and may have structures which provide different topographies thereon. Furthermore, it is contemplated that the shape of the handle member may be other than symmetrical relative to the bisecting plane, while, maintaining some of the spatial relationships between the different coupling assemblies. It will further be understood that caps may interface with other caps while the handle members may have different configurations. For example, the outer perimeter 47 of the handle member may be varied while, for example, the position of the handle tabs 80 (which will be described in detail herein below) can remain in similar or identical special configurations.

Figure 7:
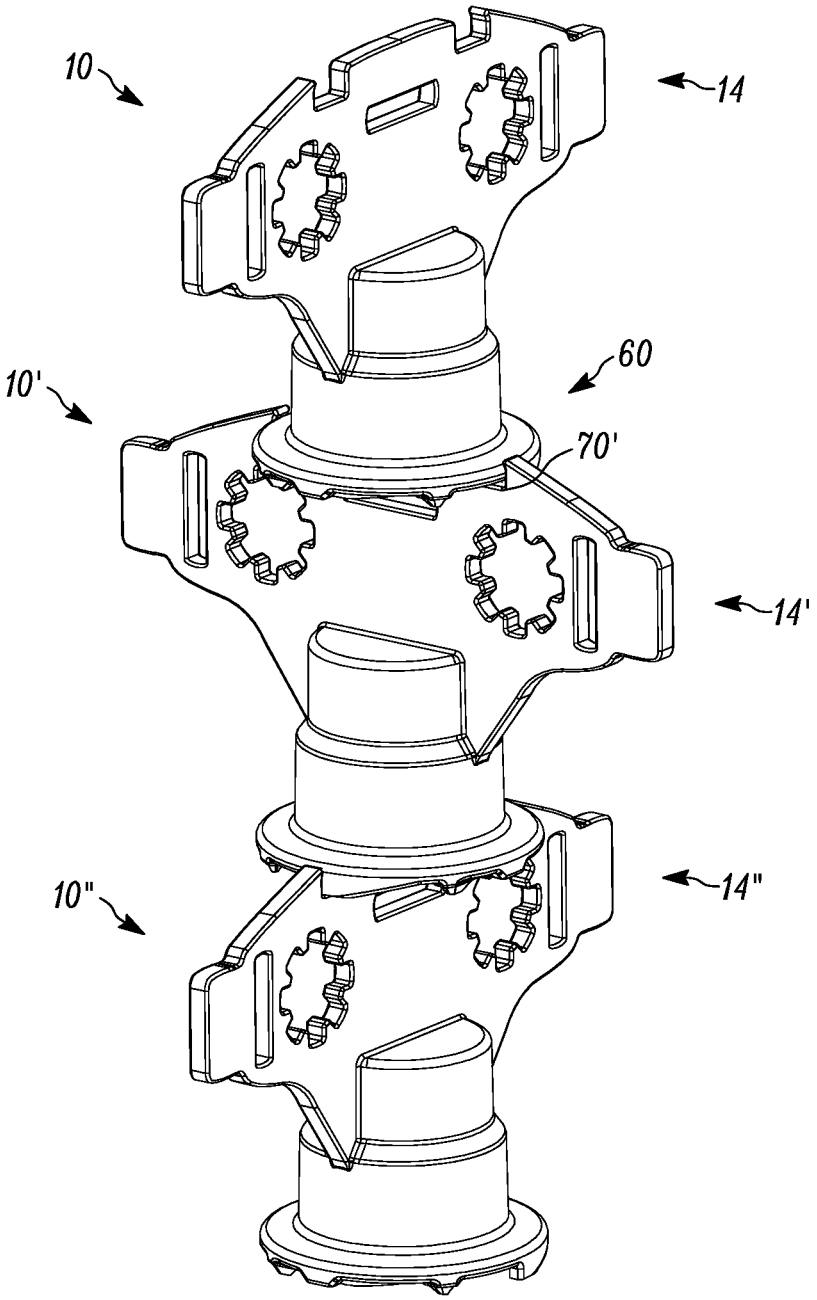
FIG. 7 of the drawings is an assembly of caps for a pouch showing coupling through the first stacking coupling assembly of the caps.

The first stacking coupling assembly 16 includes spout engagement portion 60 and handle engagement portion 70. In the configuration shown, the first stacking coupling assembly provides the structures necessary to couple caps in a stacked orientation, or in a spout to handle configuration. One such configuration is shown in FIG. 7, and will be described in greater detail below. That is, a handle member of a first cap can be releasably coupled to a spout engaging body of a second cap. Further caps can be attached to either the first or the second cap in a similar manner. Thus, the spout engagement portion 60 engages a handle member of an adjacent cap, whereas the handle engagement portion engages a spout of an adjacent cap.

Referring again to FIGS. 2 through 6, the spout engagement portion 60 includes first spout mating structure **62*a* and second spout mating structure 62*b*. The two spout engagement structures are generally mirror images of each other taken about the bisecting plane 58. As a result, the first spout mating structure 62*a* will be described with the understanding that the second spout mating structure 62*b*** is substantially identical. Additionally, similar structures will have the same reference number, with the adjoining letter "a" changed to a letter "b".

The first spout mating structure **62*a* includes protrusion 64*a* (which is a part of the lower annular flange 28 and a portion of the depending skirt 26). The protrusion defines inner surface 65*a*, outer surface 66*a* and base 67*a*. Portions of the base 67*a* (which comprises the lower lip 37) may include protrusions or the like to define a rotational stop 68*a*, which precludes relative rotation of the coupled caps relative to each other about the axis 39**.

The second spout mating structure is substantially identical, as noted above, and includes protrusion 64*b* which has an inner surface 65*b*, outer surface 66*b* and base 67*b*. The base 67*b* may further include rotational stop 68*b*.

The handle engagement portion 70 includes first handle mating structure 72*a* and second handle mating structure 72*b*. The handle engagement portion 70 is generally defined at or near the upper end 52 of the central region 44 of the handle member 14. It will be understood that the first handle mating structure 72*a* is substantially an identical mirror image of the second handle mating structure 72*b* about the bisecting plane 59. As they are identical, the first handle mating structure will be described in detail with the understanding that the second handle mating structure is substantially identical. Additionally, like structures will have the same reference number augmented with an "a" on the first handle mating structure and augmented with a "b" on the second handle mating structure.

The first handle mating structure 72*a* includes slot 74*a*. The slot 74*a* includes inner surface 76*a*, outer surface 77*a* and base 78*a*. The surfaces extend between the first and second side of the handle member and are generally perpendicular thereto. The outer surface 77*a* further includes an upper inward lip 79*a*. The dimensions of the slot 74*a* generally match the protrusion 64*a* of the first spout mating structure.

Similarly, the second handle mating structure 72*b* includes slot 74*b*. The slot 74*b* includes inner surface 76*b*, outer surface 77*b* and base 78*b*. The base 78*b* includes upper inward lip 79*b*. As will be understood, the dimensions of the slot 74*b* generally match the protrusion 64*b* of the second spout mating structure.

As will be explained below, the engagement of a spout engaging portion of a first cap with the handle engagement portion of a second cap is achieved through mated engagement and based on an interference fit. It will be understood that the interference fit may be between the respective protrusion 64*a*, 64*b* with the respective slot 74*a*, 74*b*, or may be through an interference fit between components of the respective protrusion 64*a*, 64*b* and the respective slot 74*a*, 74*b* and their cross cooperation. That is, the interference may be, for example, between the inner surfaces 76*a*, 76*b* of the slots with the inner surfaces 65*a*, 65*b* of the protrusions, such that the tab formed between the slots 74*a*, 74*b* is sandwiched by the opposing walls of the depending skirt and lower flange of the spout engaging body.

The multimode handle coupling assembly 18 is shown in FIGS. 2 through 6 as comprising handle tabs 80 and a plurality of slots, including mode one slots, mode two slots and mode three slots. The handle tabs 80 include first handle tab 82*a* and second handle tab 82*b*. The handle tabs are generally identical and mirror images of each other taken generally about the bisecting plane 59. As such, the handle tab 82*a* will be described with the understanding that handle tab 82*b* is substantially an identical mirror image thereof.

The handle tab 82*a* is formed of a substantially uniform cross-sectional configuration and define front surface 83*a* (which generally corresponds to the shape of the cross-sectional configuration), upper surface 84*a* and lower surface 85*a*. The handle tab extends away from the central region, with the upper and lower surfaces being substantially perpendicular to the axis 39, and in the configuration shown, substantially parallel to the top surface. Further, the length of the upper and lower surfaces 84*a*, 85*a* are such that they are longer than the thickness of the handle member, such that when inserted into a slot of the mode one, mode two or mode three slots, these handle tabs will extend through. In the configuration shown, the length may be in excess of twice the thickness of the handle member.

The handle tab 82*b* is substantially similar and includes a front surface 83*b*, an upper surface 84*b* and a lower surface 85*b*. In the configuration shown, the upper and lower surfaces 84*a* and 84*b* are substantially coplanar with the respective one of the upper and lower surfaces 84*b*, 85*b*. Similarly, the front surfaces 83*a*, 83*b* are substantially parallel to each other.

The mode one slots comprise a first mode one slot 90*a* and a second mode one slot 90*b*. The slot 90*a* is defined inboard of the first handle tab 82*a*, and is substantially parallel to the axis 39 (and in the shown configuration, parallel to the front surface 83*a*). The slot is dimensioned to fit the handle tab therein in an interference fit. The slot is positioned such that the slot corresponds to the tab so that the upper end of the slot corresponds to the upper surface and the bottom of the slot corresponds to the lower surface. The mode one slot can receive a handle tab in two different configurations, that is, in a first manner, and when the handle tab is flipped, in a second manner.

Similarly, the slot 90*b* is a mirror image of the slot 90*a* taken about the axis 39. That is, the slot 90*b* is inboard of the second handle tab 82*b*. The upper end of the slot 90*b* corresponds to the upper surface with the lower end of the slot 90*b* corresponding to the lower surface.

While two mode one slots are shown, it will be understood that additional mode one slots (that is, slots that are parallel to the axis 39) can be disposed on the handle member.

The mode two slot comprise first mode two slot 92. The mode two slot 92 is positioned so as to be substantially perpendicular to the mode one slots and to the axis 39, and in the configuration shown, the axis 39 bisects the mode two slot 92. Further, the mode two slot is inboard of the upper end 52 of the central region 44, and in the configuration shown, generally parallel to the top surface 24 of the spout engaging body 12. The mode two slot 92 is positioned closer to the upper end 52 than to the root 50, in the configuration shown. It will be understood that the shape of the slot corresponds to the shape of the handle tab 82*a*, 82*b*. It is further understood that while a single mode two slot is shown, a plurality of mode two slots may be disposed on the handle member. For example, mode two slots may be positioned outboard of the mode one slots, and may cooperate with (extend into) the handle tabs. As with the mode one slots, the mode two slots can receive a handle tab in two orientations, a first one and then when the handle is flipped, in a second one.

It will be understood that in the configuration shown, the mode one slots are substantially perpendicular to the mode two slots. Such a configuration may be maintained, while the slots may each be oblique to the axis 39. In other configurations, the two slots may be oblique relative to each other, and oblique to the axis 39, or, one of the slot modes may be parallel or perpendicular to the axis 39 with the other being oblique.

The mode three slots comprise first multi direction slot 94*a* and second multi direction slot 94*b*. In the configuration shown, the two multi direction slots are substantially identical, and mirror images of each other about the axis 39. As such, the first multi direction slot 94*a* will be described with the understanding that the second multi direction slot 94*b* is substantially identical thereto. As such, identical structures of each of the slots will be augmented with an "a" for the first multi direction slot and with a "b" for the second multi direction slot.

The first multi direction slot 94*a* is positioned inboard of the first mode one slot 90*a* and outboard of the first mode two slot 92. The first multi direction slot 94*a* comprises a central opening 96*a* and a plurality of radial slot portion pairs, such as slot portion pair 98*a*. In the configuration shown, a total of four radial slot portion pairs are shown, each offset by 45°, with one of the four radial slot portion pairs being parallel to the first mode one slot 90*a* and to the axis 39, one of the four radial slot portion pairs being perpendicular to the first mode one slot 90*a* (and parallel to the first mode two slot 92), with two pairs being perpendicular to each other and offset 45° from the other slot cross pair. Such a configuration allows for four different position configuration of a handle tab that is inserted therethrough. That is, the handle tab can be inserted into any one of the four different radial slot portion pairs. It will be understood that the slot portion pairs are generally centered about the central opening, and each slot portion pair defines an axis that extends through the center of the central opening. It will be understood that the radial slot portion pair that is parallel to the first mode one slot 90*a* includes a configuration that substantially matches that of the first mode one slot 90*a* such that they are side by side in a corresponding fashion. In the configuration shown, a portion of the first multi direction slot 94*a* is inboard of the first handle mating structure 72*a*.

The second multi direction slot 94*b* includes a central opening 96*b* and a plurality of radial slot portion pairs, such as radial slot portion pair 98*b*. As indicated above, the second multi direction slot 94*b* is a mirror image of the first about the axis 39.

In the configuration shown, a pair of mode three slots are provided. It will be understood that further mode three slots could be provided. It will further be understood that each of the slots may comprise mode three slots, that is, the mode one slots, the mode two slot may each be replaced with a mode three slot. In the configuration shown, the mode three slot allows for relative positioning of two caps in the same relative configuration as the mode one slot and in the same relative configuration as the mode two slot. Of course, in other configurations, it will be understood that such configurations may be varied such that each of the radial slot portion pairs are oblique to each of the mode one and the mode two slots. In the configuration shown, only some of the mode three radial slot portion pairs are oblique to the mode one and the mode two slots. Further, it will be understood that while the slots are generally positioned so as to be symmetrical about the axis 39, variations are contemplated, as are an odd number of the different slots of the mode one, mode two and mode three slots.

In operation, initially, preferably, a cap is provided on a pouch. The user removes the cap from the pouch and consumes the material (foodstuffs) within the pouch. Eventually, the user has a plurality of caps and the user can begin to assemble the different caps into different structures by coupling the different caps in different manners. As discussed above, the caps can be coupled together utilizing the first stacking coupling assembly or the multimode handle coupling assembly, and each will be described in turn below. It will be understood that there is no limit on the configurations that are formed through the coupling of multiple caps and there is no limit as to how many caps can be coupled together.

With reference to FIG. 7, three caps 10, 10' and 10" are coupled together utilizing the first stacking coupling assemblies of each of the caps. In particular, the spout engagement portion 60 of the cap 10 engages handle engagement portion 70' of cap 10'. And, the spout engagement portion 60' of the cap 10' engages handle portion 70" of cap 10'. In the configuration shown, the handle members 14, 14' and 14" are arranged so that the handle member 14' is perpendicular to the handle member 14 and 14". The rotational stops 68*a*, 68*b* (FIGS. 2 through 6) preclude relative rotation between the respective ones of the caps. In other configurations, it is contemplated that a plurality of stops may be defined so as to allow for coupling at predetermined relative angles so that handle members of adjacent caps can be oriented at predetermined angles relative to each other (and those angles may render the handle members oblique to each other).

Additionally, it will be contemplated that an unlimited number of additional caps can be coupled utilizing the first stacking coupling assemblies to form a long chain. It will be understood that an interference fit between the adjacent caps precludes inadvertent decoupling. When desired, however, a user can separate two adjacent caps from each other.

Figure 8:
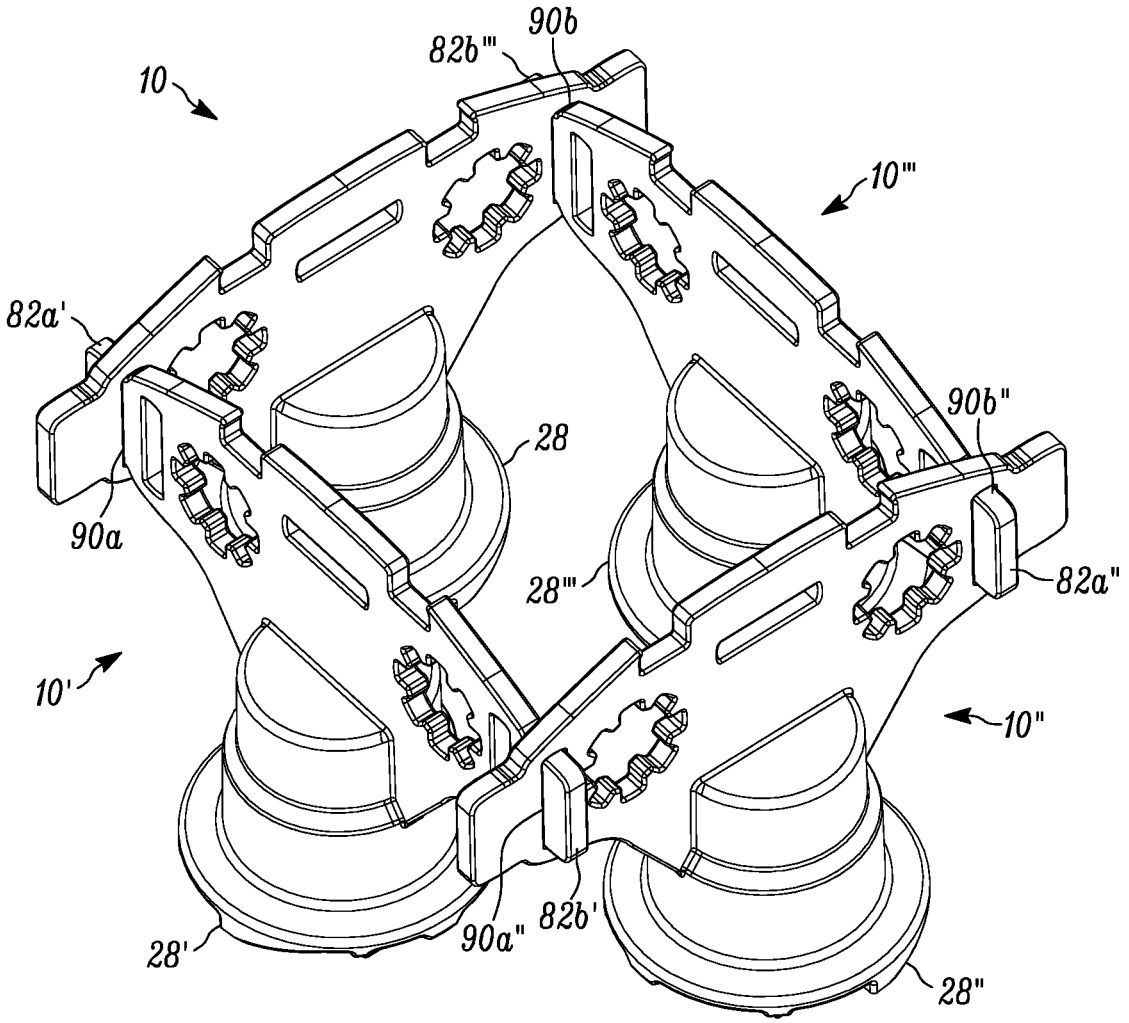
FIG. 8 of the drawings is an assembly of caps for a pouch showing coupling through the multimode handle coupling assembly, and in particular, through implementation of the mode one slots.

With reference to FIG. 8, four caps 10, 10', 10" and 10'" are coupled together utilizing the mode one slots in combination with the handle tabs of the multimode handle coupling assembly of each of the four caps. In particular, first handle tab 82*a'* extends through first mode one slot 90*a* and second handle tab 82*b'* extends through first mode one slot 90*a"*. Similarly, first handle tab 82*a'"* extends through second mode one slot 90*b"* and second handle tab 82*b'"* extends through second mode one slot 90*b*. With the relative spacing of the handle tabs and the mode one slots, the lower flanges 28-28'" of the spout engaging body of each of the caps lies in the same plane. Of course, other configurations are contemplated, wherein the different caps are not coplanar. Moreover, as the slot surfaces are generally perpendicular to the first and second sides of the handle members, the resulting configuration is substantially square, as each cap is generally perpendicular to that cap to which it is coupled through the tabs and the mode one slots. Again, it is contemplated that the slots may have walls that are oblique to the first and second sides of the handle members, which may result in shapes that are different than substantially square.

Figure 9:
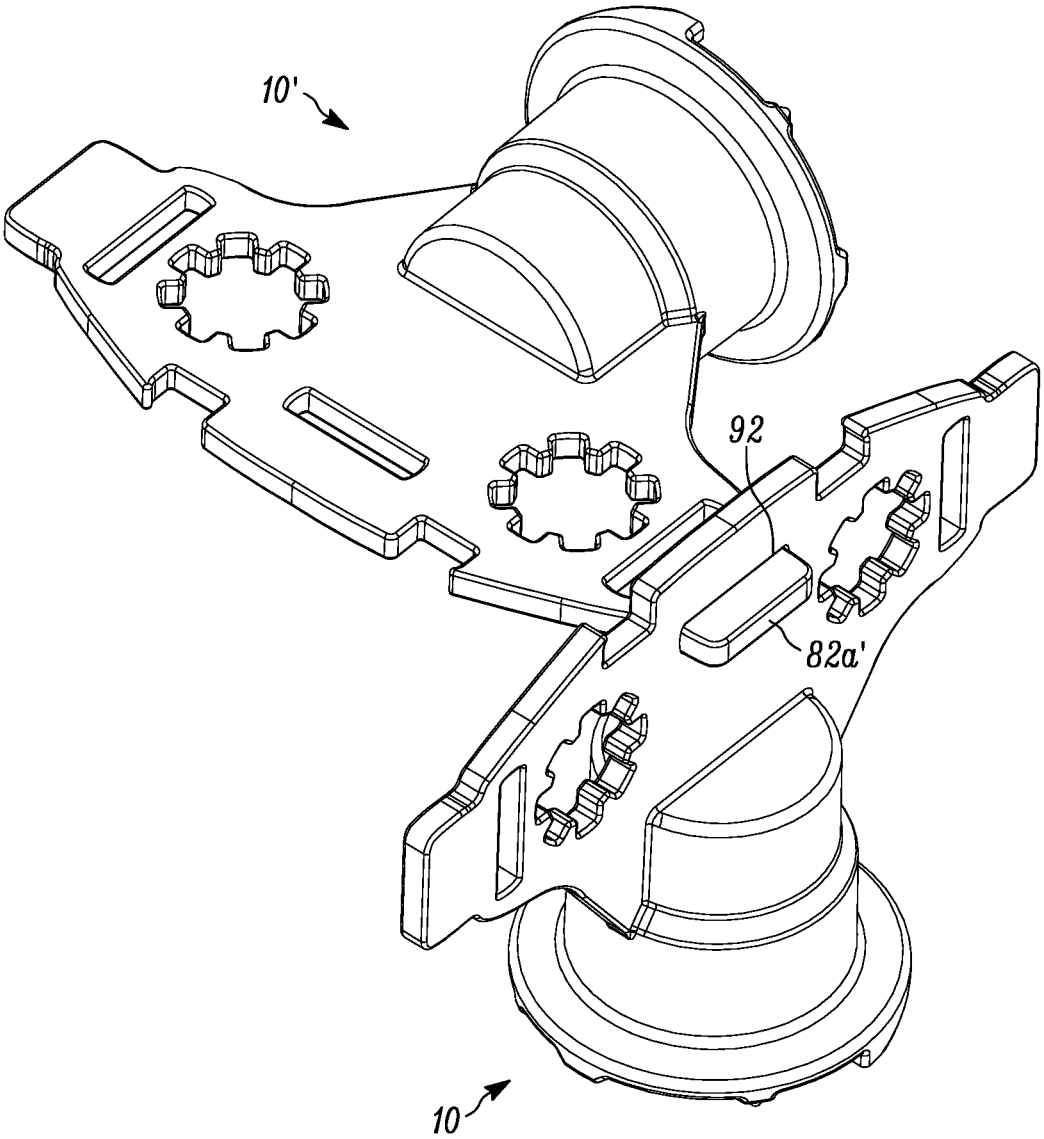
FIG. 9 of the drawings is an assembly of caps for a pouch showing coupling through the multimode handle coupling assembly, and in particular, through implementation of the mode two slot.

With reference to FIG. 9, two caps 10, 10' are coupled together utilizing the mode two slot. In the configuration shown, the first handle tab 82*a'* of the cap 10' is inserted through the first second mode two slot 92 of the cap 10 to attach the two caps together. In the configuration shown, as the surfaces of the first mode two slot 92 is generally perpendicular to the first and second sides of the respective handle member, the handle member 10' is perpendicular to the handle member 10. It will be understood that the member 10' could have been flipped so that when the first handle tab 82*a'* was inserted into the first second mode two slot 92, the body was on the opposite side. Additionally, it will be understood that instead of the first handle tab, the second handle tab could have been utilized instead, in two different orientations.

Figure 10:
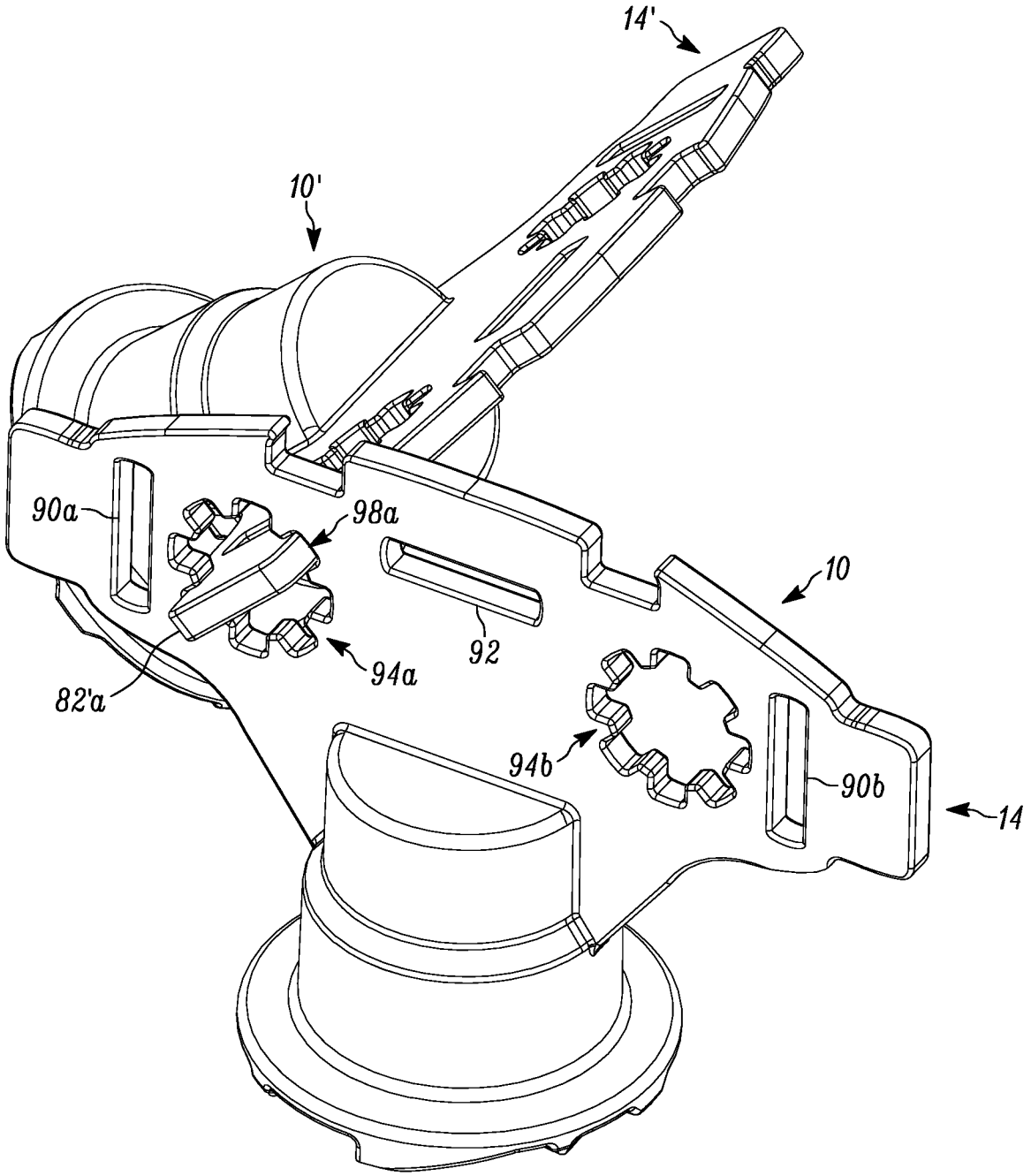
FIG. 10 of the drawings is an assembly of caps for a pouch showing coupling through the multimode handle coupling assembly, and in particular, through implementation of the mode three slots.

With reference to FIG. 10, two caps 10, 10' are coupled together utilizing a mode three slot. In particular, in the configuration shown, the first handle tab 82*a'* is inserted through the first multi direction slot 94*a*. In the configuration shown, the handle tab utilizes a radial slot portion pair 98*a* that is oblique to each of the first second mode two slot 92 and the first mode one slot 90*a*, and as a result, the handle member 14 and the handle member 14' are oblique relative to each other. In the configuration shown, the two planes that the handle members define are offset perpendicular in one plane but angled at 45° relative to each other in another plane. This intersection allows for three dimensional building of structures that have surfaces that are oblique to other surfaces, and adds the dimension of obliqueness to the overall structure. It will be understood that any of the other radial slot portion pairs could have been utilized, some of which would have resulted in perpendicular planes of the respective handle members in different planes, or an oblique relationship that is perpendicular to the configuration shown.

Figure 11:
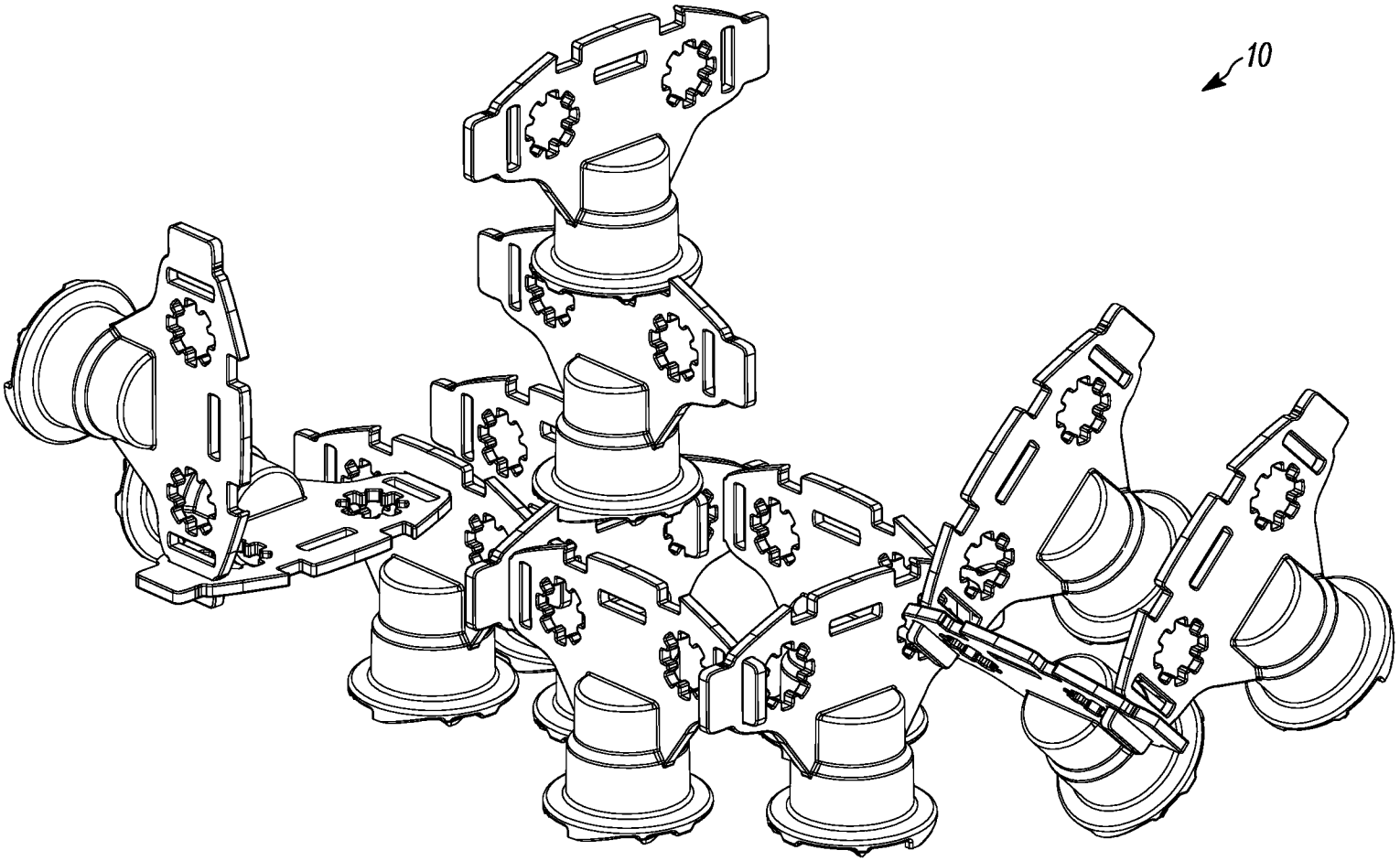
FIG. 11 of the drawings is an assembly of caps for a pouch showing coupling through the first stacking coupling assembly and the multimode handle coupling assembly, in each of the mode one, mode two and mode three slots, in varying configurations.

With reference to FIG. 11, a total of thirteen caps are coupled together utilizing various combinations of the first stacking coupling assembly and the multimode handle coupling assembly. Indeed, some of the caps utilize combinations of different ones of the mode one, mode two and mode three slots, whereas others utilize combinations of the first stacking coupling assembly with one or more of the mode one, mode two and mode three slots. For example, parallel configurations can be created by utilizing adjacent mode one and mode three slots of a first cap and having a cap extend on either side of this first cap. The configuration shown in FIG. 11 is merely exemplary and merely forms one of a number of different configurations that is possible with the caps of the present disclosure. Indeed, an infinite number of different configurations, utilizing differing quantities of caps is contemplated. With the different variations that can be made to the caps and the first stacking coupling assembly and the multimode handle coupling assembly, the variations are truly limitless.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A cap for a pouch comprising:

a spout engaging body including a depending skirt defining a central bore configured to engage a spout, the central bore defining a central axis;

a handle member extending from the spout engaging body; and a multimode handle coupling assembly including:

at least one handle tab formed into the handle member;

at least one mode three slot, the at least one mode three slot including a multi direction slot defined in the handle member having a central opening and a plurality of radial slot portion pairs, to, in turn, sized to receive a handle tab of another cap in a plurality of orientations; and a first stacking coupling assembly including:

a spout engagement portion on the spout engagement body, comprising one of a pair of slots centered about the central axis; and a handle engagement portion on the handle member, comprising a pair of tabs, centered about the central axis, wherein the handle engagement portion and the spout engagement portion define mating structures such that the spout engagement portion of the cap is structurally configured to releasably couple to a handle engagement portion of a second cap in a stacked configuration wherein the central axis of the cap and the second cap are colinear, to, in turn, be vertically aligned.

2. The cap of claim 1 wherein the multi direction slot includes at least four radial slot portion pairs, intersecting at the central opening, and radially spaced about the central opening.

3. The cap of claim 2 wherein the depending skirt defines an axis of rotation, with the handle member defining a planar configuration that bisects the depending skirt and extends through the axis of rotation.

4. The cap of claim 3 wherein the axis of rotation bisects the handle member, with one of the at least two mode three slots being positioned on a first side of the axis of rotation and the other of the at least two mode three slots being positioned on a second side of the axis of rotation.

5. The cap of claim 4 wherein the at least one handle tab comprises a first handle tab and a second handle tab, the first handle tab extending from the handle member on the first side of the axis of rotation such that the mode three slot on the first side of the axis is positioned between the first handle tab and the axis of rotation, and the second handle tab extending from the handle member on the second side of the axis of rotation such that the mode three slot on the second side of the axis is positioned between the second handle tab and the axis of rotation.

6. The cap of claim 5 wherein the first handle tab corresponds spatially to one radial slot portion pair such that when a handle tab of a second cap is inserted therethrough, a plane defined by a lower end of the depending skirt of the cap, and a plane defined by a lower end of the depending skirt of the second cap are coplanar.

7. The cap of claim 4 further comprising at least one mode one slot and at least one mode two slot, each of the at least one mode slot and the at least one mode two slot structurally configured to receive a handle tab of a second cap in two orientations.

8. The cap of claim 7 wherein the at least one mode slot is oriented perpendicular to the at least one mode two slot.

9. The cap of claim 8 wherein the at least one mode one slot comprises a first mode one slot and a second mode one slot, the first mode one slot being positioned between the first mode three slot and the first handle tab and the second first mode one slot being positioned between the second mode three slot and the second handle tab.

10. The cap of claim 9 wherein the at least one mode two slot is positioned between the first mode three slot and the second mode three slot, so as to straddle the axis or rotation.

11. The cap of claim 1 wherein the at least one mode three slot includes at least two mode three slots defined in the handle member.

12. The cap of claim 1 wherein the handle engagement portion further comprises:

a first handle mating structure including a slot and a second handle mating structure including a slot, the slots defining a mating configuration to the spout engagement portion.

13. The cap of claim 12 wherein the first and second handle mating structures are positioned at an upper end of a central region of the handle member.

14. The cap of claim 13 wherein the handle member further includes a first wing region positioned to a first side of the central region and a second wing region positioned on a second side of the central region, wherein the at least one handle tab comprises a first handle tab extending from the first wing region and a second handle tab extending from the second wing region, and the at least one mode three slot comprising a first mode three slot defined in the first wing region inboard of the first handle tab, and a second mode three slot defined in the second wing region inboard of the second handle tab.

15. A cap for a pouch comprising:

a spout engaging body including a depending skirt defining a central bore configured to engage a spout, the central bore defining a central axis;

a handle member extending from the spout engaging body; and a multimode handle coupling assembly including:

at least one handle tab formed into the handle member; and at least one mode three slot, the at least one mode three slot including a multi direction slot defined in the handle member having a central opening and a plurality of radial slot portion pairs, to, in turn, sized to receive a handle tab of another cap in a plurality of orientations; and a first stacking coupling assembly structurally configured to couple one of the handle member of the cap to a spout engaging body of a second cap or the spout engaging body of the cap to a handle member of a second cap so that the central axis of the cap and a central axis of a second cap are colinear, so as to be vertically aligned.

16. The cap of claim 15 wherein the multimode handle coupling assembly further comprises at least one mode one slot defined in the handle member and at least one second mode slot defined in the handle member.

17. A method of coupling an assembly of caps comprising a first cap and a second cap, the method comprising the steps of:

providing a first cap and a second cap, each cap having the configuration according to claim 16; and attaching the second cap to the first cap through one of the multimode handle coupling assembly and the first stacking coupling assembly.

18. The method of claim 17 further comprising the steps of:

providing a subsequent cap;

coupling the subsequent cap to a previously assembled cap; and repeating the steps of providing and coupling.

19. An assembly of caps formed through the method of claim 17.

* * * * *